US008935890B2

(12) United States Patent
Chen et al.

(10) Patent No.: US 8,935,890 B2
(45) Date of Patent: Jan. 20, 2015

(54) APPARATUS AND METHOD FOR REVERSE RECTIFICATION

(71) Applicants: Guangzhou DI-ER Construction & Engineering Co., Ltd., Guangzhou (CN); Guangzhou Construction Engineering Co., Ltd., Guangzhou (CA)

(72) Inventors: Zhenying Chen, Guangzhou (CN); Long Wang, Guangzhou (CN); Junyue Gao, Guangzhou (CN); Mingqiu Yao, Guangzhou (CN); Shaobin Tang, Guangzhou (CN); Han Huang, Guangzhou (CN); Jingwen Hu, Guangzhou (CN); Qianyi He, Guangzhou (CN); Weijian Yu, Guangzhou (CN); Guoxiong Wang, Guangzhou (CN)

(73) Assignees: Guangzhou DI•ER Construction Engineering Co., Ltd., Guangzhou (CN); Guangzhou Construction Engineering Co., Ltd., Guangzhou (CN)

( * ) Notice: Subject to any disclaimer, the term of this patent is extended or adjusted under 35 U.S.C. 154(b) by 0 days.

(21) Appl. No.: 14/022,018

(22) Filed: Sep. 9, 2013

(65) Prior Publication Data

US 2014/0305069 A1 Oct. 16, 2014

(30) Foreign Application Priority Data

Apr. 16, 2013 (CN) ..... 2013 1 0132294

(51) Int. Cl.
*E04H 1/00* (2006.01)
*E04B 1/35* (2006.01)

(52) U.S. Cl.
CPC ..... *E04B 1/35* (2013.01); *E04B 2001/3588* (2013.01)
USPC ..... 52/79.12; 52/127.2; 52/126.3

(58) Field of Classification Search
CPC ..... E02B 17/021; E04G 21/142; B25B 5/061; E04B 2001/3583
USPC ..... 52/79.12, 127.2, 126.3, 150, 271, 52/582.1; 254/93 R, 2 B, 134, 133 R, 100, 254/103
See application file for complete search history.

(56) References Cited

U.S. PATENT DOCUMENTS 3,797,793 A * 3/1974 Moritz et al. ..... 248/295.11
3,823,861 A * 7/1974 Jureit et al. ..... 227/153

(Continued)

FOREIGN PATENT DOCUMENTS

CN 202047608 U 11/2011
CN 202954378 U 5/2013

*Primary Examiner* — Basil Katcheves
*Assistant Examiner* — Joshua Ihezie
(74) *Attorney, Agent, or Firm* — Muncy, Geissler, Olds & Lowe, P.C.

(57) ABSTRACT

The present invention disclosed an apparatus for reverse rectification, relating to the field of civil engineering technology. The apparatus for reverse rectification comprises two sets of steel plate hooks, which are reversely arranged and respectively fixed on the building and the skewed large-scale structure that needs to be rectified, and a jack which is horizontally placed on the steel plate hooks. The steel plate hooks, which are driven by the jack, push the skewed structure towards the existed building, whereby the skewed structure and the existed building can be spliced correctly. This present invention has more advantages, e.g. simple structure and convenient operability, which can improve the construction efficiency and reduce the construction costs. Therefore it can be widely used in the field of civil engineering technology. Further, the present invention also discloses a method for reverse rectification by using the apparatus.

4 Claims, 5 Drawing Sheets

(56) References Cited

U.S. PATENT DOCUMENTS

| | | | | | |
|---|---|---|---|---|---|
| 3,900,179 | A * | 8/1975 | Mocny et al. | 248/287.1 |
| 4,103,503 | A * | 8/1978 | Smith | 405/196 |
| 4,620,691 | A * | 11/1986 | Waters, Jr. | 254/16 |
| 4,947,530 | A * | 8/1990 | Gleason | 29/402.14 |
| 5,288,187 | A * | 2/1994 | Ward | 410/100 |
| 5,419,657 | A * | 5/1995 | Davis | 405/209 |
| 5,997,217 | A * | 12/1999 | Verret | 405/196 |
| 6,935,628 | B1 * | 8/2005 | Conversa | 269/147 |
| 7,594,361 | B2 * | 9/2009 | Tragant Ruano | 52/79.9 |
| 8,429,871 | B2 * | 4/2013 | Ingjaldsdottir et al. | 52/582.1 |
| 2006/0196132 | A1 * | 9/2006 | Ruano | 52/236.3 |
| 2008/0014028 | A1 * | 1/2008 | Faires et al. | 405/230 |
| 2009/0194749 | A1 * | 8/2009 | Mirocha | 254/13 |

* cited by examiner

APPARATUS AND METHOD FOR REVERSE RECTIFICATION

CROSS REFERENCE TO RELATED APPLICATIONS

This application claims priority of Application No. 201310132294.9 filed in China on Apr. 16, 2013, under 35 U.S.C. §119, the entire contents of which are hereby incorporated by reference.

FIELD OF THE INVENTION

The present invention relates to civil engineering technology, in particular an apparatus for reverse rectification.

The present invention also relates to a method for reverse rectification.

BACKGROUND OF THE INVENTION

The hoisting of large-scale structure is often required in the construction process. It happens frequently that the upper part of the large-scale structure skews outward, going away from the existed building when the large-scale structure has been lifted during the process of hoisting, because of the uneven positioning of the lifting points. As shown in FIG. 1, the upper part of the large-scale structure 2 skews outward, going away from the existed building 3. It will cost a huge amount of manpower and equipments to pull the skewed structure 2 weighing up to thousand tons towards to the exited building 3, to be in a proper position, in order to splice the large-scale structure 2 with the existed building 3.

Electric hoist is used in conventional way to force the steel structure back to normal track. In order to force the steel structure weighing up to thousand tons back to normal track, a plurality of electric hoists must work together, but it really takes time to install those electric hoists, while it will be complicated to operate those electric hoists simultaneously, thereby this way will result in high construction cost as well as low construction efficiency. Furthermore, the electric hoists have a poor safety performance which will cause accidents more easily.

SUMMARY OF THE INVENTION

According to a first aspect of the present invention, there is provided an apparatus for reverse rectification.

According to a second aspect of the present invention, there is provided a method for reverse ratification.

With regard to the solution for the above defects, the present invention provides the following:

An apparatus for reverse rectification comprises two sets of steel plate hooks, and a jack being configured between the two sets of steel plate hooks. Each steel plate hook has two opposite ends, i.e. a bent-up end and a welding end respectively. The two sets of steel plate hooks are reversely placed, wherein the welding ends of the first set of steel plate hooks are fixed onto an existed building by welding, and the bent-up ends thereof reach out towards a skewed structure that needs to be rectified. Likewise, the welding ends of the second set of steel plate hooks are fixed onto the skewed structure by welding, and the bent-up ends thereof reach out towards the existed building. The jack is placed between the bent-up ends of two sets of steel plate hooks.

In order to increase the accessible area between the jack and the steel plate hooks, for more even stress, each set of steel plate hook comprises two steel plate hooks, wherein two steel plate hooks of the second set of steel plate hooks are set abutting each other, and two steel plate hooks of the first set of steel plate hooks are set separately with interval where the two abutting hooks of the second set of steel plate hooks are placed.

In order to better fix the jack, the bent-up ends of the first set of steel plate hooks are equipped with a transition plate, which is used for increasing the accessible area between the pedestal of the jack and the bent-up ends of the first set of steel plate hooks.

For convenient operation, the jack is screw jack. A hydraulic jack can be used in case that it is difficult to rectify a skewed large-scale structure by hand jack.

The method for reverse rectification according to the present invention is as follows:

(1) Welding two steel plate hooks of the first set of steel plate hooks onto the edge of an existed building, wherein the two steel plate hooks are at a certain distance one another, and the bent-up ends of the first set of steel plate hooks reach out towards a skewed structure that needs to be rectified;

(2) Welding two steel plate hooks of the second set of steel plate hooks onto the edge of the skewed structure that needs to be rectified, wherein the bent-up ends of the second set of steel plate hooks reach out towards the existed building; The first and second sets of steel plate hooks are reversely placed and the second set of steel plate hooks are placed between the first set of the steel plate hooks;

(3) Setting a transition plate over the bent-up ends of the first set of steel plate hooks, said transition plate is used for increasing the accessible area of the bent-up ends;

(4) Placing a jack horizontally on the space between the two sets of steel plate hooks, wherein the pedestal of the jack sustains the transition plate, and the head of to the jack sustains the bent-up ends of the second set of steel plate hooks;

(5) Actuating the jack, the head of the jack extends, and the jack pushes the bent-up ends of the two set of steel plate hooks away from each other, whereby the distance between the bent-up ends of the two set of steel plate hooks will be increasing, while the distance between the welding ends of the two set of steel plate hooks will be shortening due to the two set of steel plate hooks being reversely placed each other, therefore the skewed structure fixed to the welding ends of the second set of steel plate hooks will be moved towards the existed building fixed to the welding ends of the first set of steel plate hooks until the desired position, then the structure can be fixed to the existed building properly.

Comparing with the prior art, the present invention can achieve the following advantages:

The present invention ingeniously matches the usage of jack with the two sets of steel plate hooks, and is convenient to install and easy to operate. It can quickly realize the adjustment of the skewed large-scale structure and make it to a desirable position with safe performance, low construction cost and high construction efficiency.

BRIEF DESCRIPTION OF THE DRAWINGS

The present invention will be further described in details hereinafter with the reference to accompanying drawings and exemplary embodiment.

LIST OF REFERENCE CHARACTERS

Figure 1:
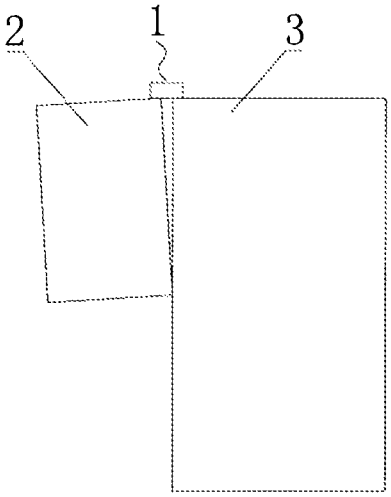
FIG. 1 is an installation schematic view of the present invention.

1 apparatus for reverse rectification
11 first set of steel plate hooks
12 transition plate
13 jack
14 second set of steel plate hooks
15 welding end
2 skewed structure
3 existed building.

DETAILED DESCRIPTION OF PREFERRED EMBODIMENT

Figure 2:
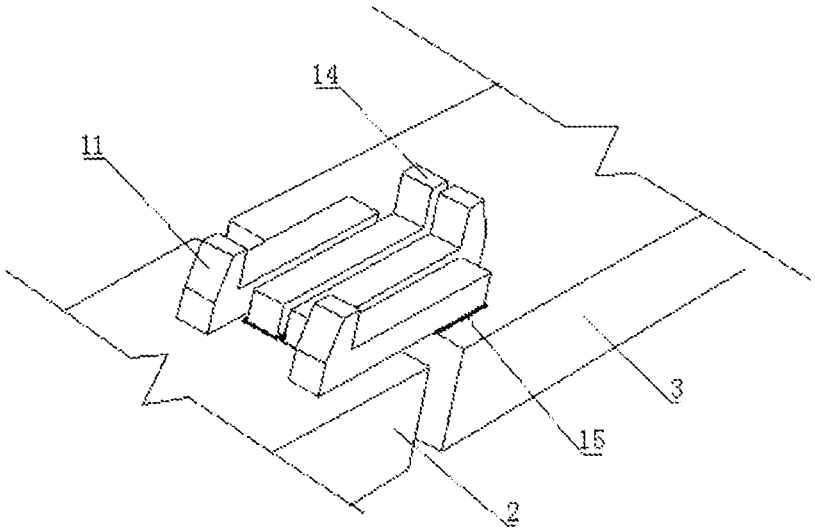
FIG. 2 is an installation schematic view of the steel plate hook of the present invention.
Figure 3:
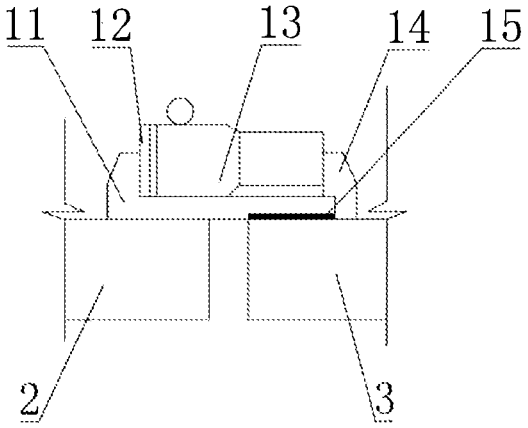
FIG. 3 is a front view of the present invention before the skewed structure is rectified.
Figure 4:
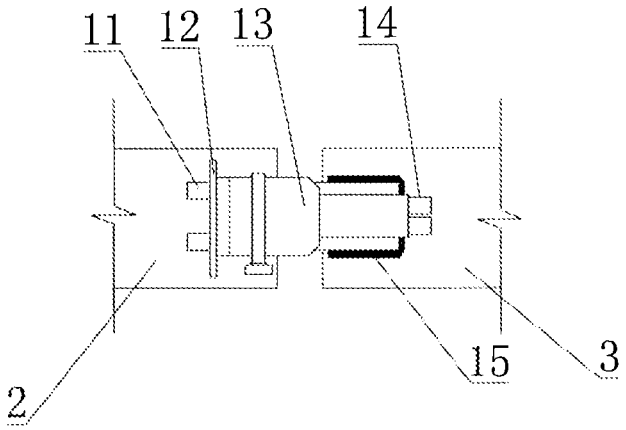
FIG. 4 is a top view of the present invention before the skewed structure is rectified.
Figure 5:
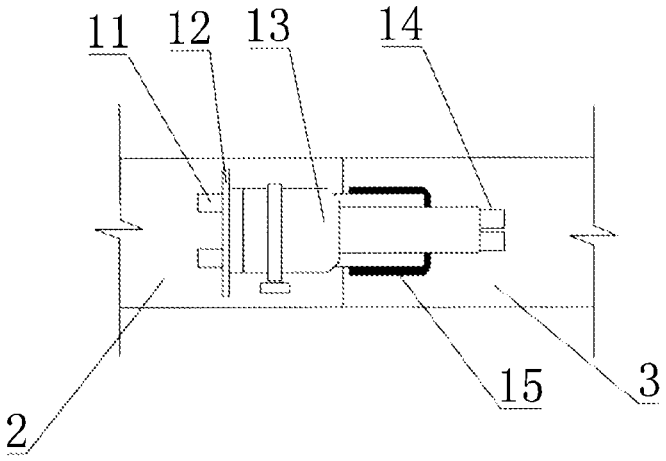
FIG. 5 is a top view of the present invention after the skewed structure was rectified.

Referring to FIG. 1 to FIG. 5, an apparatus for reverse rectification according to the present invention comprises first set of steel plate hooks 11 fixed on the existed building 3, second set of steel plate hooks 14 fixed on the skewed structure 2 that needs to be rectified, and the jack 13 which is arranged between the first and second sets of the steel plate hooks 11, 14. The jack 13 is a screw jack or a hydraulic jack. Each steel plate hook has two opposite ends, i.e. a bent-up end and a welding end 15 respectively. The welding ends 15 of the first set of steel plate hooks 11 are fixed onto the existed building 3 by welding, and their bent-up ends reach out towards the skewed structure 2. The first set of steel plate hooks 11 and the second set of steel plate hooks 14 are reversely placed, the welding ends of the second set of steel plate hooks 14 are fixed onto the skewed structure 2 by welding, and their bent-up ends reach out towards the existed building 3. In this embodiment, the second set of steel plate hooks 14 is set between the two steel plate hooks of the first set of steel plate hooks 11. The head of the jack 13 sustains the bend-up ends of the second set of steel plate hooks 14. The pedestal of the jack 13 sustains a transition plate 12 that is arranged between the bent-up ends of the first set of steel plate hooks 11 and the pedestal of the jack 13, the transition plate 12 is welded onto the bent-up ends of the first set of steel plate hooks 11, such that the pedestal of the jack 13 can act on the bent-up ends of the hooks 11 by means of the transition plate 12.

The method for reverse rectification according to the present invention is as follows:

(1) Welding the welding ends of two steel plate hooks of the first set of steel plate hooks 11 onto the edge of an existed building 3, wherein the two steel plate hooks are at a certain distance one another, and the bent-up ends of the first set of steel plate hooks 11 reach out towards a skewed structure 2 that needs to be rectified;

(2) Welding the welding ends of two steel plate hooks of the second set of steel plate hooks 14 onto the edge of the skewed structure 2 that needs to be rectified, wherein the bent-up ends of the second set of steel plate hooks 14 reach out towards the existed building 3; The first and second sets of steel plate hooks 11, 14 are reversely placed and the second set of steel plate hooks 14 are placed between the first set of the steel plate hooks 11;

(3) Setting a transition plate 12 over the bent-up ends of the first set of steel plate hooks 11, said transition plate 12 is used for increasing the accessible area of the bent-up ends;

(4) Placing a jack 13 horizontally on the space between the two sets of steel plate hooks 11, 14, wherein the pedestal of the jack 13 sustains the transition plate 12, and the head of the jack 13 sustains the bent-up ends of the second set of steel plate hooks 14;

(5) Actuating the jack 13, the head of the jack 13 extends, and the jack 13 pushes the bent-up ends of the two set of steel plate hooks 11, 14 away from each other, whereby the distance between the bent-up ends of the two set of steel plate hooks 11, 14 will be increasing, while the distance between the welding ends of the two set of steel plate hooks 11, 14 will be shortening due to the two set of steel plate hooks 11, 14 being reversely placed each other, therefore the skewed structure 2 fixed to the welding ends of the second set of steel plate hooks 14 will be moved towards the existed building 3 fixed to the welding ends of the first set of steel plate hooks 11 until the desired position, then the structure 2 can be fixed to the existed building 3 properly.

The present invention, which is assembled simply, operated conveniently and safely, not only saves the construction cost and reduces construction equipments but also enhances construction efficiency.

The embodiment described hereinbefore is merely preferred embodiment of the present invention and not for purposes of any restrictions or limitations on the invention. It will be apparent that any non-substantive, obvious alterations or improvement by the technician of this technical field according to the present is invention may be incorporated into ambit of claims of the present invention.

What is claimed is:

1. An apparatus for reverse rectification between an existing building and a skewed structure, comprising two sets of steel plate hooks and a jack being configured between the two sets of steel plate hooks, wherein each steel plate hook has two opposite ends, one end is a bent-up end while the other end is a welding end; the two sets of steel plate hooks are reversely placed, wherein the welding ends of the first set of steel plate hooks are fixed onto the existing building by welding, and the bent-up ends thereof reach out towards the skewed structure that needs to be rectified, while the welding ends of the second set of steel plate hooks are fixed onto the skewed structure by welding, and the bent-up ends thereof reach out towards the existing building; the space between the bent-up ends of the two sets of steel plate hooks is adapted to receive the jack; wherein each set of the steel plate hooks comprises two steel plate hooks, and two hooks of the second set of steel plate hooks are set abutting each other while two hooks of the first set of steel plate hooks are set separately with interval where the two hooks of the second set of steel plate hooks are placed.

2. The apparatus of claim 1 , wherein the bent-up ends of the first set of steel plate hooks are equipped with a transition plate which is used for increasing the accessible area between a pedestal of the jack and the bent-up ends of the first set of steel. plate hooks.

3. The apparatus of claim 1, wherein the jack is a screw jack or a hydraulic jack.

4. A method of using the apparatus of claim 1, comprising the steps of:

welding two steel plate hooks of the first set of steel plate hooks onto an edge of the existing building, wherein the two steel plate hooks are at a certain distance one from another, and the bent-up ends of the first set of steel plate hooks reach out towards the skewed structure that needs to be rectified;

welding two steel plate hooks of the second set of steel plate hooks onto an edge of the skewed structure that needs to be rectified, wherein the bent-up ends of the second set of steel plate hooks reach out towards the existing building; the first and second sets of steel plate hooks are reversely placed and the second set of steel plate hooks are placed between the first set of the steel plate hooks;

setting a transition plate over the bent-up ends of the first set of steel plate hooks, said transition plate is used for increasing the accessible area of the bent-up ends;

placing a jack horizontally on the space between the two sets of steel plate hooks, wherein a pedestal of the jack sustains the transition plate, and a head of the jack sustains the bent-up ends of the second set of steel plate hooks; and actuating the jack, the head of the jack extends, and the jack pushes the bent-up ends of the two set of steel plate hooks away from each other, the skewed structure fixed to the welding ends of the second set of steel plate hooks will be moved towards the existing building fixed to the welding ends of the first set of steel plate hooks until the desired position, then the structure can be fixed to the existing building properly.

* * * * *

UNITED STATES PATENT AND TRADEMARK OFFICE

CERTIFICATE OF CORRECTION

PATENT NO. : 8,935,890 B2
APPLICATION NO. : 14/022018
DATED : January 20, 2015
INVENTOR(S) : Zhenying Chen et al.

It is certified that error appears in the above-identified patent and that said Letters Patent is hereby corrected as shown below:

On the title page, item (71) Applicants, for Guangzhou Construction Engineering Co. Ltd., the country of mailing incorrectly appears as "CA" and should be corrected to --"CN"--.

Signed and Sealed this
Twenty-sixth Day of May, 2015

Michelle K. Lee

Michelle K. Lee
*Director of the United States Patent and Trademark Office*